US010364487B2

(12) United States Patent
Park et al.

(10) Patent No.: US 10,364,487 B2
(45) Date of Patent: Jul. 30, 2019

(54) HIGH ENTROPY ALLOY HAVING TWIP/TRIP PROPERTY AND MANUFACTURING METHOD FOR THE SAME

(71) Applicant: Seoul National University R&DB Foundation, Seoul (KR)

(72) Inventors: Eun Soo Park, Suwon (KR); Hyun Seok Oh, Seoul (KR); Sangjun Kim, Seoul (KR); Kooknoh Yoon, Seoul (KR); Chae Woo Ryu, Suwon (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 129 days.

(21) Appl. No.: 15/428,259

(22) Filed: Feb. 9, 2017

(65) Prior Publication Data

US 2017/0233855 A1 Aug. 17, 2017

(30) Foreign Application Priority Data

Feb. 15, 2016 (KR) ..... 10-2016-0016958
Oct. 14, 2016 (KR) ..... 10-2016-0133523

(51) Int. Cl.
*C22C 1/02* (2006.01)
*C22C 19/05* (2006.01)
(Continued)

(52) U.S. Cl.
CPC ..... *C22C 38/58* (2013.01); *C22C 1/023* (2013.01); *C22C 19/058* (2013.01); *C22C 19/07* (2013.01);
(Continued)

(58) Field of Classification Search
CPC ..... C22C 38/58; C22C 1/023; C22C 19/058; C22C 19/07; C22C 22/00; C22C 30/00; C22C 33/04; C22C 38/52; C22C 27/06
See application file for complete search history.

(56) References Cited

U.S. PATENT DOCUMENTS

2013/0338757 A1* 12/2013 Gerold ..... A61F 2/06 623/1.15

FOREIGN PATENT DOCUMENTS

JP 4190720 12/2008

OTHER PUBLICATIONS

Otto et al., "Relative effects of enthalpy and entropy on the phase stability of equiatomic high-entropy alloys," Acta Materialia 61 (2003) 2628-2639. (Year: 2013).*

(Continued)

*Primary Examiner* — Anthony J Zimmer
(74) *Attorney, Agent, or Firm* — Lex IP Meister, PLLC

(57) ABSTRACT

The present invention relates to a high entropy alloy having more improved mechanical properties by controlling contents of additive elements in a NiCoFeMnCr 5-element alloy to control stacking fault energy, thereby controlling stability of a γ austenite phase to control a transformation mechanism, wherein the stacking fault energy is controlled in a composition range of $Ni_aCo_bFe_cMn_dCr_e$ (a+b+c+d+e=100, 1≤a≤50, 1≤b≤50, 1≤c≤50, 1≤d≤50, 10≤e≤25, and 77a−42b−22c+73d−100e+2186≤1500), and thus, the γ austenite phase exhibits a twin-induced plasticity (TWIP) property or a transformation induced-plasticity (TRIP) property in which the γ austenite phase is subjected to phase transformation into an ε martensite phase or an α' martensite phase, under stress, thereby having improved strength and elongation at the same time to have excellent mechanical properties.

18 Claims, 14 Drawing Sheets

(51) Int. Cl.

| | |
|---|---|
| ***C22C 19/07*** | (2006.01) |
| ***C22C 22/00*** | (2006.01) |
| ***C22C 27/06*** | (2006.01) |
| ***C22C 30/00*** | (2006.01) |
| ***C22C 33/04*** | (2006.01) |
| ***C22C 38/52*** | (2006.01) |
| ***C22C 38/58*** | (2006.01) |

(52) U.S. Cl.
CPC ..... *C22C 22/00* (2013.01); *C22C 27/06* (2013.01); *C22C 30/00* (2013.01); *C22C 33/04* (2013.01); *C22C 38/52* (2013.01)

(56) References Cited

OTHER PUBLICATIONS

Tasan, et al., "Composition Dependence of Phase Stability, Deformation Mechanisms, and Mechanical Properties of the CoCrFeMnNi High-Entropy Alloy System," JOM, vol. 66, bo. 10, 2013, p. 1994-. (Year: 2013).*

Tasi et al., "Sluggish diffusion in Co—Cr—Fe—Mn—Ni high-entropy alloys," Acta Materialia 61 (2013) 4887-4897. (Year: 2013).*

Bernd Gludovatz, et al., "A fracture-resistant high-entropy alloy for cryogenic applications", Science, vol. 345, Issue 6201, pp. 1153-1158, Sep. 5, 2014.

Zhiming Li, et al., "Metastable high-entropy dual-phase alloys overcome the strength-ductility trade-off", Nature, vol. 534, pp. 227-230, Jun. 9, 2016.

* cited by examiner

HIGH ENTROPY ALLOY HAVING TWIP/TRIP PROPERTY AND MANUFACTURING METHOD FOR THE SAME

CROSS-REFERENCE TO RELATED APPLICATION

This application claims priority to and the benefit of Korean Patent Application No. 10-2016-0016958 and 10-2016-0133523 filed in the Korean Intellectual Property Office on Feb. 15, 2016 and Oct. 14, 2016, the entire contents of which are incorporated herein by reference.

BACKGROUND OF THE INVENTION (a) Field of the Invention

The present invention relates to a high entropy alloy having TWIP (twin induced plasticity)/TRIP (transformation induced plasticity) property. More specifically, the present invention relates to a high entropy alloy having more improved mechanical properties by controlling stacking fault energy to express the TWIP/TRIP property on a γ austenite phase in a matrix, and a manufacturing method for the same.

(b) Description of the Related Art

A high entropy alloy is an alloy system in which a large number of metal elements are constituted at a similar fraction and all constituent elements added act as common main elements which is unlike single main element-based alloys of a commercial alloy system according to the related art, wherein a high mixed entropy is induced due to similar atomic fraction in the alloy, and thus, a solid solution having a stable and simple structure at high temperature is formed instead of an intermetallic compound or an intermediate phase.

Such a high entropy alloy has attracted attention as a new material in a metal field because it has excellent mechanical properties including high strength and ductility, etc. Recently, as it has been known that the high entropy alloy exhibits excellent properties even in extreme environmental physical properties such as high-temperature property and low-temperature property, etc., an active research for utilization thereof continues. However, since most of the researches are stayed at a level of confirming the mechanical properties by manufacturing an alloy composed at an equi-atomic fraction which is easy to form a single solid solution high entropy alloy, and thus, efforts to obtain more improved mechanical properties based on the high entropy alloy have not been significant.

PATENT REFERENCE (Patent Reference 1) Japanese Registration Patent No. 4190720

NON-PATENT REFERENCE (Non-Patent Reference 1) Science, Vol. 345, Issue 6201, pp. 1153-1158

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a high entropy alloy having TWIP (twin induced plasticity)/TRIP (transformation induced plasticity) property, having advantages of improving mechanical properties by controlling added amounts of constituent elements of the high entropy alloy having the TWIP/TRIP property to reduce stacking fault energy, thereby increasing variability of a γ austenite phase. In addition, the present invention has an object of providing a high entropy alloy having excellent mechanical properties in which as the stacking fault energy of the high entropy alloy is reduced, a γ austenite single phase microstructure or a dual-phase microstructure simultaneously having a γ austenite phase and an ε martensite phase is formed from an initial state without stress, and the γ austenite phase exhibits a twin-induced plasticity (TWIP) property or a transformation induced-plasticity (TRIP) property in which the γ austenite phase is subjected to stress-induced phase transformation into an ε martensite phase or an α' martensite phase, under stress, thereby having improved strength and elongation at the same time.

An examplary embodiment of the present invention provides a high entropy alloy having TWIP (twin induced plasticity)/TRIP (transformation induced plasticity) property, which is a high entropy alloy in which constituent elements function as common main elements, and is represented by Chemical Formula of DeletedTexts.

In order to constitute the high entropy alloy, it generally needs to satisfy conditions in which metal elements having a similar interatomic size of 10% or less and a mixed thermal relation close to 0 are selected, and synthesized at a similar atomic ratio with a content deviation of ±10% or less among the corresponding elements, etc. The high entropy alloy of the present invention is composed of five elements of Ni, Co, Fe, Mn, and Cr, which are period 3 transition metal elements having the similar interatomic size of about 10% or less and the mixed thermal relation close to almost 0. However, as compared to the conventional high entropy alloy, i.e., $Ni_{20}CO_{20}Fe_{20}Mn_{20}Cr_{20}$ in which respective constituent elements are constituted at the same fraction, the high entropy alloy according to an embodiment is a small alloy system in which a free energy change $\Delta G_{hcp\text{-}fcc\ or\ bcc\text{-}fcc}$) at the time of phase transformation from the γ austenite phase (face centered cubic, FCC phase) to the ε martensite phase (hexagonal close-packed, HCP phase) or α' (body centered tetragonal, BCT phase) martensite phase by Calphad calculation, and has a non-equiatomic composition. Particularly, a ratio of the sum of Fe and Co (Fe, Co) to the sum of Ni and Mn (Ni, Mn) is increased to reduce the stacking fault energy (SFE), and thus, the high entropy alloy may include the γ austenite single phase microstructure or the dual-phase microstructure simultaneously having the γ austenite phase and the ε martensite phase, and the γ austenite phase in a matrix may exhibit the TWIP or TRIP behavior under stress.

The high entropy alloy having the TWIP/TRIP property of the present invention is composed of a non-equi-atomic constituent element combination, and in particular, the stacking fault energy may be significantly reduced by controlling a content ratio of (Fe, Co) to (Ni, Mn) in an increased direction, as compared to that of the conventional high entropy alloy. In addition, the high entropy alloy also includes the γ austenite single phase or the dual-phase microstructure simultaneously having the γ austenite phase and the ε martensite phase, and the γ austenite phase exhibits the stress-induced phase transformation property into the ε or α' martensite phase under stress, thereby having improved strength and elongation at the same time to exhibit excellent mechanical properties.

Meanwhile, the high entropy alloy having TWIP (twin induced plasticity)/TRIP (transformation induced plasticity)

property according to an embodiment of the present invention may further include 10 at. % or less of at least one element of C, N, Al, Ti, V, Cu, Zr, Nb, or Mo, and thus, it is possible to improve properties by strengthening a solid solution or strengthening a precipitation.

In Chemical Formula of the high entropy alloy having TWIP (twin induced plasticity)/TRIP (transformation induced plasticity) property, $77a-42b-22c+73d-100e+2186 \leq 1500$.

In Chemical Formula of the high entropy alloy having TWIP (twin induced plasticity)/TRIP (transformation induced plasticity) property, $77a-42b-22c+73d-100e+2186 \leq 500$.

In Chemical Formula of the high entropy alloy having TWIP (twin induced plasticity)/TRIP (transformation induced plasticity) property, $77a-42b-22c+73d-100e+2186 \leq 200$.

In Chemical Formula of the high entropy alloy having TWIP (twin induced plasticity)/TRIP (transformation induced plasticity) property, $1 \leq a \leq 7$, $32 \leq b \leq 50$, $32 \leq c \leq 50$, $1 \leq d \leq 7$, and $15 \leq e \leq 25$.

Another embodiment of the present invention provides a manufacturing method for a high entropy alloy having TWIP (twin induced plasticity)/TRIP (transformation induced plasticity) property including: preparing a raw material; and manufacturing the high entropy alloy by dissolving the raw material, wherein the raw material is prepared to satisfy Chemical Formula of $Ni_aCo_bFe_cMn_dCr_e$ ($a+b+c+d+e=100$, $1 \leq a \leq 50$, $1 \leq b \leq 50$, $1 \leq c \leq 50$, $1 \leq d \leq 50$, $10 \leq e \leq 25$, and $77a-42b-22c+73d-100e+2186 \leq 1500$), and a free energy change ($\Delta G_{hcp-fcc}$) when the γ austenite phase in the manufactured high entropy alloy is phase-transformed into an ε martensite phase is 1500 J/mol or less (based on calculation of Thermo Calc, TCFE8).

In designing the high entropy alloy of the present invention, the high entropy alloy may be designed on the basis of the free energy change ($\Delta G_{hcp-fcc}$) at the time of the phase transformation from the γ austenite phase into the ε martensite phase as an index related to the stacking fault energy. It is possible to obtain the high entropy alloy in which the free energy change ($\Delta G_{hcp-fcc}$) when the γ austenite phase is phase-transformed into the ε martensite phase is 1500 J/mol or less, the γ austenite phase may exhibit the TWIP property, and when the free energy change is 500 J/mol or less, the γ austenite phase may exhibit the TRIP property.

In particular, when the free energy change ($\Delta G_{hcp-fcc}$) at the time of the phase transformation from the γ austenite phase into the ε martensite phase is 200 J/mol or less while satisfying the condition above, it is possible to manufacture a dual-phase high entropy alloy in which the γ austenite phase and the ε martensite phase are simultaneously precipitated during solidification, and the TRIP property is exhibited through the stress-induced phase transformation from the γ austenite phase into the ε martensite phase in the matrix during strain. In addition, when the free energy change ($\Delta G_{bcc-fcc}$) at the time of the phase transformation when the γ austenite phase is phase-transformed into the α' martensite phase of a BCT crystal structure is −2500 J/mol or less (based on calculation of Thermo Calc, TCFE8), it is possible to obtain a dual-phase high entropy alloy capable of being subjected to stress-induced multi-stage phase transformation from the γ austenite phase to the α' martensite phase through the ε martensite phase in the matrix during the strain.

Here, a homogenization treatment may be preferably performed after the manufacturing of the high entropy alloy, and the homogenization treatment is performed by hot rolling a manufactured ingot to 80% or less of an original thickness, and annealing in an Ar atmosphere at about 1200±300° C. for about 48 hours or less, followed by quenching.

In addition, in order to control a microstructure size of the homogenized high entropy alloy, the manufacturing method may further include cold rolling the homogenized high entropy alloy to 10% or more of an original thickness, and annealing in an Ar atmosphere at about 900±200° C. for about 24 hours or less, followed by quenching.

The stacking fault energy of the high entropy alloy having the TWIP/TRIP property according to embodiments may be greatly reduced, thereby increasing phase instability of an austenite phase having a FCC crystal structure. Thus, the high entropy alloy with increased phase instability of the austenite phase generates an effect in which plastic strain (TWIP) by twin formation, phase transformation from FCC to HCP, multi-stage phase transformation (TRIP) from FCC through HCP to BCC, or a pre-strain martensite phase is formed by stress even at room temperature, and thus, mechanical properties may be significantly improved as compared to those of the high entropy alloy having the same fraction.

In addition, the high entropy alloy of the present invention has the unique TWIP/TRIP property to simultaneously improve strength and elongation which are generally in an inverse relationship with each other, and to have a low thermal expansion coefficient and a relatively slow diffusion rate. Therefore, the high entropy alloy may be applied not only as materials for offshore plants and structural materials for polar extreme environment which require excellent toughness and high strength at a low temperature, but also as structural materials for high-temperature extreme environment which require an excellent high-temperature creep property and high-temperature strength, such as pojectile propulsion units, nuclear pressure vessels, cladding tubes, and high-efficiency next generation turbine blades for thermal power generation, etc.

DETAILED DESCRIPTION OF THE EMBODIMENTS

Embodiments of the present invention are described in detail with reference to accompanying drawings.

The present invention is intended to further improve mechanical properties by controlling stacking fault energy of the above-described high entropy alloy to control a strain mechanism, and has an object of providing a high entropy alloy having excellent mechanical properties in which a γ austenite single phase microstructure or a dual-phase microstructure simultaneously having a γ austenite phase and an ε martensite phase is formed, and the γ austenite phase exhibits a twin-induced plasticity (TWIP) property or a transformation induced-plasticity (TRIP) property by an ε or α' martensite phase under stress, thereby having improved strength and elongation at the same time.

To this end, the high entropy alloy of the present invention is composed of five elements of Cr, Mn, Fe, Co, and Ni, which are metal elements having a similar interatomic size of 10% or less and a mixed thermal relation close to almost 0. However, as compared to the conventional high entropy alloy, i.e., $Cr_{20}Mn_{20}Fe_{20}Co_{20}Ni_{20}$ (so called a Cantor alloy) in which respective constituent elements are constituted at the same fraction, the high entropy alloy of the present invention has a state in which an entire composition is not in the same fraction by predicting an alloy system with a small free energy change ($\Delta G_{hcp\text{-}fcc}$) during the phase transformation from the γ austenite (FCC) into the ε martensite (HCP) through Calphad calculation and first principle calculation. In particular, a content ratio of (Fe, Co) to (Ni, Mn) may be controlled in an increased direction to reduce the stacking fault energy, and thus, the TWIP/TRIP behavior may be generated on the austenite phase at the time of stress application.

Figure 1:
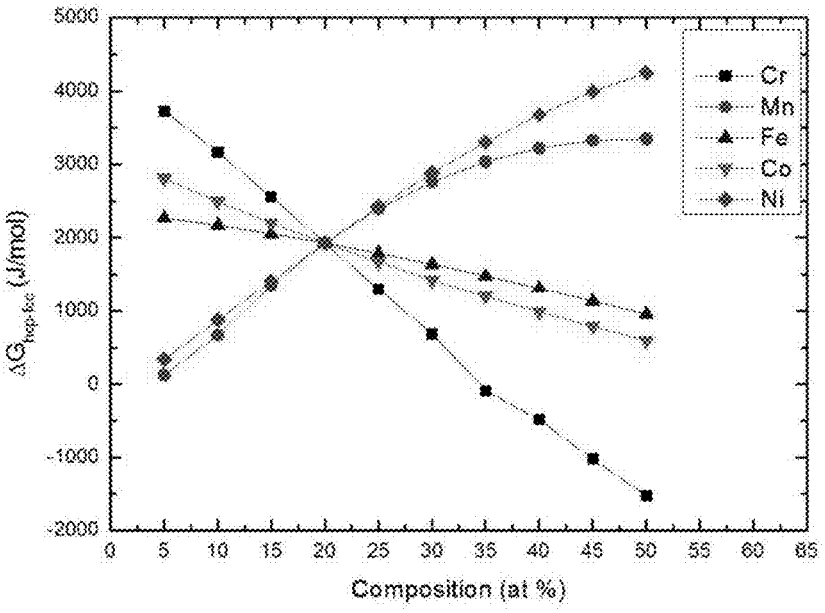
FIG. 1 is a graph showing a free energy change ($\Delta G_{hcp-fcc}$) at the time of phase transformation according to contents of respective elements in a NiCoFeMnCr 5-element alloy by using Calphad calculation.

FIG. 1 is a graph showing a free energy change ($\Delta G_{hcp\text{-}fcc}$) at the time of phase transformation according to contents of respective elements in a NiCoFeMnCr 5-element alloy by using Calphad calculation. When one element changes, remaining elements are allowed to have the same fraction. At this time, compositions of the respective elements varied from 5 to 50%. Table 1 shows calculation results.

TABLE 1

| | | Composition | | | | | | | | |
|---|---|---|---|---|---|---|---|---|---|---|
| | | Cr | Mn | Fe | Co | Ni | $G_{fcc}$ | $G_{hcp}$ | $\Delta G_{hcp\text{-}fcc}$ | $\Delta G'_{hcp\text{-}fcc}$ |
| Cr | 1 | 5 | 23.75 | 23.75 | 23.75 | 23.75 | −14615 | −10883 | 3732 | 3755 |
| | 2 | 10 | 22.5 | 22.5 | 22.5 | 22.5 | −13858 | −10683 | 3175 | 3146 |
| | 3 | 15 | 21.25 | 21.25 | 21.25 | 21.25 | −13031 | −10476 | 2555 | 2537 |
| | 4 | 20 | 20 | 20 | 20 | 20 | −12162 | −10234 | 1928 | 1928 |
| | 5 | 25 | 18.75 | 18.75 | 18.75 | 18.75 | −11267 | −9965 | 1302 | 1319 |
| | 6 | 30 | 17.5 | 17.5 | 17.5 | 17.5 | −10360 | −9674 | 686 | 710 |
| | 7 | 35 | 16.25 | 16.25 | 16.25 | 16.25 | −9363 | −9450 | −87 | 101 |
| | 8 | 40 | 15 | 15 | 15 | 15 | −8546 | −9033 | −487 | −507 |
| | 9 | 45 | 13.75 | 13.75 | 13.75 | 13.75 | −7656 | −8683 | −1027 | −1116 |
| | 10 | 50 | 12.5 | 12.5 | 12.5 | 12.5 | −6788 | −8314 | −1526 | −1725 |
| Mn | 11 | 23.75 | 5 | 23.75 | 23.75 | 23.75 | −8831 | −8708 | 123 | 504 |
| | 12 | 22.5 | 10 | 22.5 | 22.5 | 22.5 | −10068 | −9396 | 672 | 978 |
| | 13 | 21.25 | 15 | 21.25 | 21.25 | 21.25 | −11211 | −9856 | 1355 | 1453 |
| | 14 | 20 | 20 | 20 | 20 | 20 | −12162 | −10234 | 1928 | 1928 |
| | 15 | 18.75 | 25 | 18.75 | 18.75 | 18.75 | −12935 | −10538 | 2397 | 2403 |
| | 16 | 17.5 | 30 | 17.5 | 17.5 | 17.5 | −13541 | −10776 | 2765 | 2878 |
| | 17 | 16.25 | 35 | 16.25 | 16.25 | 16.25 | −13989 | −10949 | 3040 | 3352 |
| | 18 | 15 | 40 | 15 | 15 | 15 | −14287 | −11063 | 3224 | 3827 |
| | 19 | 13.75 | 45 | 13.75 | 13.75 | 13.75 | −14450 | −11120 | 3330 | 4302 |
| | 20 | 12.5 | 50 | 12.5 | 12.5 | 12.5 | −14480 | −11129 | 3351 | 4777 |

TABLE 1-continued

| | | Composition | | | | | | | | |
|---|---|---|---|---|---|---|---|---|---|---|
| | | Cr | Mn | Fe | Co | Ni | $G_{fcc}$ | $G_{hcp}$ | $\Delta G_{hcp\text{-}fcc}$ | $\Delta G'_{hcp\text{-}fcc}$ |
| Fe | 21 | 23.75 | 23.75 | 5 | 23.75 | 23.75 | −13108 | −10840 | 2268 | 2289 |
| | 22 | 22.5 | 22.5 | 10 | 22.5 | 22.5 | −12862 | −10694 | 2168 | 2168 |
| | 23 | 21.25 | 21.25 | 15 | 21.25 | 21.25 | −12538 | −10484 | 2054 | 2048 |
| | 24 | 20 | 20 | 20 | 20 | 20 | −12162 | −10234 | 1928 | 1928 |
| | 25 | 18.75 | 18.75 | 25 | 18.75 | 18.75 | −11744 | −9955 | 1789 | 1808 |
| | 26 | 17.5 | 17.5 | 30 | 17.5 | 17.5 | −11294 | −9654 | 1640 | 1688 |
| | 27 | 16.25 | 16.25 | 35 | 16.25 | 16.25 | −10816 | −9334 | 1482 | 1568 |
| | 28 | 15 | 15 | 40 | 15 | 15 | −10314 | −9000 | 1314 | 1448 |
| | 29 | 13.75 | 13.75 | 45 | 13.75 | 13.75 | −9793 | −8654 | 1139 | 1328 |
| | 30 | 12.5 | 12.5 | 50 | 12.5 | 12.5 | −9254 | −8296 | 958 | 1208 |
| Co | 31 | 23.75 | 23.75 | 23.75 | 5 | 23.75 | −12472 | −9665 | 2807 | 2666 |
| | 32 | 22.5 | 22.5 | 22.5 | 10 | 22.5 | −12447 | −9952 | 2495 | 2420 |
| | 33 | 21.25 | 21.25 | 21.25 | 15 | 21.25 | −12337 | −10134 | 2203 | 2174 |
| | 34 | 20 | 20 | 20 | 20 | 20 | −12162 | −10234 | 1928 | 1928 |
| | 35 | 18.75 | 18.75 | 18.75 | 25 | 18.75 | −11930 | −10262 | 1668 | 1682 |
| | 36 | 17.5 | 17.5 | 17.5 | 30 | 17.5 | −11648 | −10222 | 1426 | 1436 |
| | 37 | 16.25 | 16.25 | 16.25 | 35 | 16.25 | −11318 | −10118 | 1200 | 1190 |
| | 38 | 15 | 15 | 15 | 40 | 15 | −10941 | −9952 | 989 | 944 |
| | 39 | 13.75 | 13.75 | 13.75 | 45 | 13.75 | −10519 | −9728 | 791 | 698 |
| | 40 | 12.5 | 12.5 | 12.5 | 50 | 12.5 | −10063 | −9472 | 591 | 452 |
| Ni | 41 | 23.75 | 23.75 | 23.75 | 23.75 | 5 | −9981 | −9642 | 339 | 428 |
| | 42 | 22.5 | 22.5 | 22.5 | 22.5 | 10 | −10780 | −9903 | 877 | 928 |
| | 43 | 21.25 | 21.25 | 21.25 | 21.25 | 15 | −11503 | −10093 | 1410 | 1428 |
| | 44 | 20 | 20 | 20 | 20 | 20 | −12162 | −10234 | 1928 | 1928 |
| | 45 | 18.75 | 18.75 | 18.75 | 8.75 | 25 | −12757 | −10335 | 2422 | 2428 |
| | 46 | 17.5 | 17.5 | 17.5 | 17.5 | 30 | −13283 | −10399 | 2884 | 2928 |
| | 47 | 16.25 | 16.25 | 16.25 | 16.25 | 35 | −13734 | −10428 | 3306 | 3428 |
| | 48 | 15 | 15 | 15 | 15 | 40 | −14102 | −10422 | 3680 | 3928 |
| | 49 | 13.75 | 13.75 | 13.75 | 13.75 | 45 | −14379 | −10382 | 3997 | 4428 |
| | 50 | 12.5 | 12.5 | 12.5 | 12.5 | 50 | −14556 | −10306 | 4250 | 4928 |

As shown in the drawing, it could be confirmed that the free energy change ($\Delta G_{hcp\text{-}fcc}$) was gradually decreased when contents of Cr, Fe and Co were increased, and the free energy change ($\Delta G_{hcp\text{-}fcc}$) was gradually decreased when contents of Mn and Ni were decreased. It could be confirmed that linearity was maintained when the contents of the respective elements were within 5 to 50%. Based on this, the free energy change ($\Delta G_{hcp\text{-}fcc}$) at the time of the phase transformation could be predicted through simple fitting equation in consideration of contribution degree of the respective elements at the time of phase transformation, and a result value was named $\Delta G'_{hcp\text{-}fcc}$.

The $\Delta G'_{hcp\text{-}fcc}$ could be calculated by the following Equation 1.

$$\Delta G'_{hcp\text{-}fcc}=77a-42b-22c+73d-100e+2186 \quad \text{[Equation 1]}$$

In Equation 1, a, b, c, d, and e are compositions (at %) of the respective elements. Calculated values of the $\Delta G'_{hcp\text{-}fcc}$ according to the respective composition are shown in Table 1 below.

Figure 2:
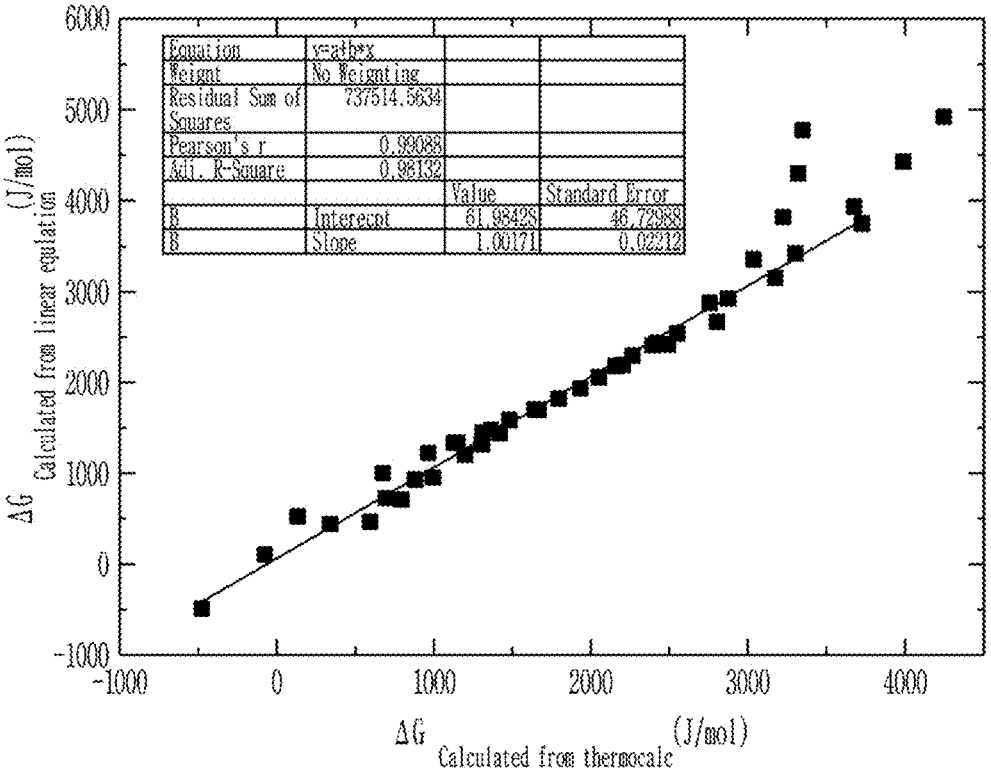
FIG. 2 shows comparison between a free energy change ($\Delta G_{hcp-fcc}$) at the phase transformation predicted by Calphad calculation and a free energy change ($\Delta G'_{hcp-fcc}$) calculated by Equation derived from the present invention in Table 1.

FIG. 2 shows comparison between a free energy change ($\Delta G_{hcp\text{-}fcc}$) at the phase transformation predicted by Calphad calculation and a free energy change ($\Delta G'_{hcp\text{-}fcc}$) calculated by Equation derived from the present invention in Table 1. As appreciated in the drawing, it could be confirmed that excellent linearity was exhibited in the entire composition range of the present invention, which indicated that the composition of the high entropy alloy could be efficiently controlled by using the $\Delta G'_{hcp\text{-}fcc}$ Equation derived from the present invention.

Figure 3:
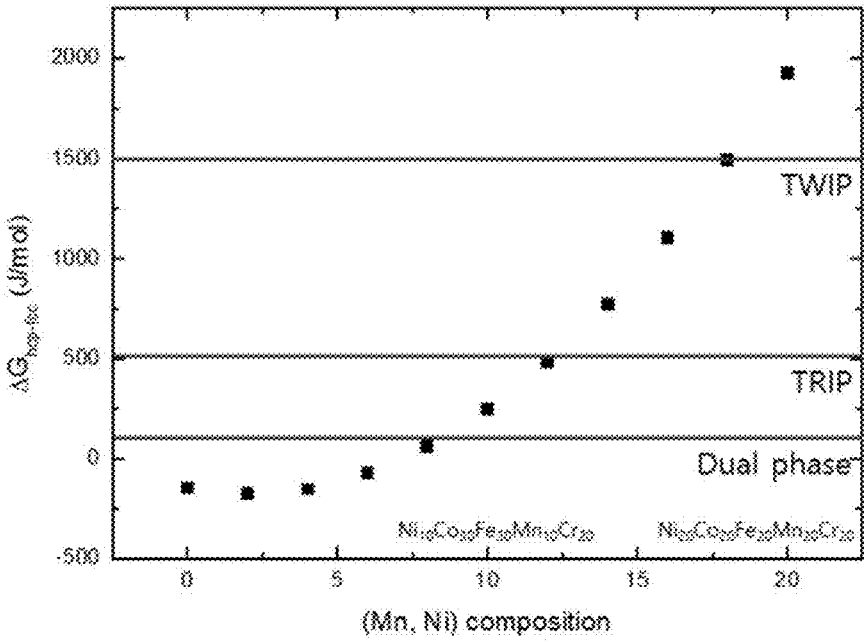
FIG. 3 is a graph showing a free energy change ($\Delta G_{hcp-fcc}$) at the time of phase transformation by controlling a content ratio of (Fe, Co) to (Ni, Mn) in an increased direction in the NiCoFeMnCr 5-element alloy using Calphad calculation.

FIG. 3 is a graph showing a free energy change ($\Delta G_{hcp\text{-}fcc}$) at the time of phase transformation by controlling a content ratio of (Fe, Co) to (Ni, Mn) in an increased direction in the NiCoFeMnCr 5-element alloy using Calphad calculation. As shown in the drawing, it could be confirmed that the free energy change ($\Delta G_{hcp\text{-}fcc}$) was gradually decreased at the time of the phase transformation by making a non-equiatomic state in the Cantor alloy and decreasing the contents of Ni and Mn while increasing the contents of Fe and Co.

For example, the free energy change ($\Delta G_{hcp\text{-}fcc}$) value was greatly reduced to be 1500 J/mol or less (based on Calphad calculation) at the time of the phase transformation by simultaneously controlling the contents of Fe and Co to be 22 at. % or more and the contents of Ni and Mn to be 18 at. % or less which are the composition ranges of the present invention in the Cantor alloy so that the fraction of the constituent elements was not the same. This reduction of the free energy change ($\Delta G_{hcp\text{-}fcc}$) with respect to the phase transformation is closely related to a decrease in the stacking fault energy in materials, and thus, a TWIP strain mechanism due to activation of a twin may appear. In addition, when a free energy change ($\Delta G_{hcp\text{-}fcc}$) value is decreased to 500 J/mol or less (based on Calphad calculation), the twin strain is further activated by instability of the γ austenite phase, and thus, it is possible to generate transformation into the TRIP strain mechanism, i.e., phase transformation into the martensite phase during the strain. Further, when the free energy change ($\Delta G_{hcp\text{-}fcc}$) value at the time of the phase transformation is greatly decreased and becomes 200 J/mol or less (Calphad calculation standard), stability of the ε martensite phase is stabilized, and a dual-phase microstructure simultaneously having the γ austenite phase and the ε martensite phase at the time of solidification appears, and in this case, the γ phase in the dual-phase exhibits the TRIP strain mechanism.

To investigate effects of the decrease in the free energy change ($\Delta G_{hcp\text{-}fcc}$) on a material strain behavior at the time of the phase transformation, Cr, Mn, Fe, Co, and Ni constituting the alloy were prepared as parent elements with a purity of 99.9%, and casted by an induction melting method having stirring effect by an electromagnetic field, and homogenized by hot rolling at a temperature of 900° C. to 50% and treating the alloy in an Ar atmosphere at 1200° C. for 3 hours. In the present invention, since the casting is able to implementing a high temperature through an arc plasma in addition to the induction melting method, the alloy is able to be manufactured through a commercial casting process by utilizing an arc melting method capable of rapidly forming a bulk homogeneous solid solution and minimizing impurities such as oxides and pores, and a resistance heating method in which temperature is able to be precisely controlled. In addition to the commercial casting method capable of dissolving raw material metals, the alloy may be manufactured by preparing raw materials into powder and the like, and sintering the materials at high temperature/high pressure by spark plasma sintering or hot isostatic pressing using powder metallurgy, and in the case of the sintering method, there are advantages in that the microstructure may be more precisely controlled and components in desired shapes may be easily manufactured. The homogenization treatment of the manufactured specimen is preferably performed by hot rolling the manufactured ingot to 80% or less of an original thickness, and annealing in an Ar atmosphere at 1200±300° C. for 48 hours or less, followed by quenching.

Then, to obtain an appropriate grain size, cold rolling was performed to obtain a thickness reduction of 80% (single phase) or 50% (dual-phase), followed by annealing in an Ar atmosphere at 900° C. for 3 minutes (single phase) or 800° C. (dual-phase) for 1 hour, thereby refining the crystal grains. In order to control the size of the microstructure of the homogenized high entropy alloy specimen, it is preferred to perform cold rolling the homogenized high entropy alloy specimen to 10% or more of an original thickness, and annealing in an Ar atmosphere at about 900±200° C. for 24 hours or less, followed by quenching.

Mixing ratios of the elements of Examples of the present invention are shown in Table 2 below.

TABLE 2

| Specimen | Composition(at %) | $\Delta G_{hcp\text{-}fcc}$ (J/mol) | Deformation mechanism (Phase species) |
|---|---|---|---|
| Comparative Example 1 | $Cr_{20}Mn_{20}Fe_{20}Co_{20}Ni_{20}$ | 1927.8 | Dislocation (γ) |
| Example 1 | $Cr_{20}Mn_{18}Fe_{22}Co_{22}Ni_{18}$ | 1494.4 | TWIP (γ) |
| Example 2 | $Cr_{20}Mn_{16}Fe_{24}Co_{24}Ni_{16}$ | 1105.4 | TWIP (γ) |
| Example 3 | $Cr_{20}Mn_{14}Fe_{26}Co_{26}Ni_{14}$ | 771.0 | TWIP (γ) |
| Example 4 | $Cr_{20}Mn_{12}Fe_{28}Co_{28}Ni_{12}$ | 482.9 | TRIP (γ) |
| Example 5 | $Cr_{20}Mn_{10}Fe_{30}Co_{30}Ni_{10}$ | 245.3 | TRIP (γ) |
| Example 6 | $Cr_{20}Mn_{8}Fe_{32}Co_{32}Ni_{8}$ | 59.4 | TRIP (γ + ε) |
| Example 7 | $Cr_{20}Mn_{6}Fe_{34}Co_{34}Ni_{6}$ | −74 | TRIP (γ + ε) |
| Example 8 | $Cr_{20}Mn_{4}Fe_{36}Co_{36}Ni_{4}$ | −154 | TRIP (γ + ε) |
| Example 9 | $Cr_{20}Mn_{2}Fe_{38}Co_{38}Ni_{2}$ | −178 | TRIP (γ + ε) |
| Comparative Example 2 | $Cr_{20}Mn_{0}Fe_{40}Co_{40}Ni_{0}$ | −147 | Dislocation (BCC) |

As shown in Table 2, a $Cr_{20}Mn_{20}Fe_{20}Co_{20}Ni_{20}$ high entropy alloy including constituent elements in the same fraction was manufactured as Comparative Example 1 of the present invention.

Figure 4:
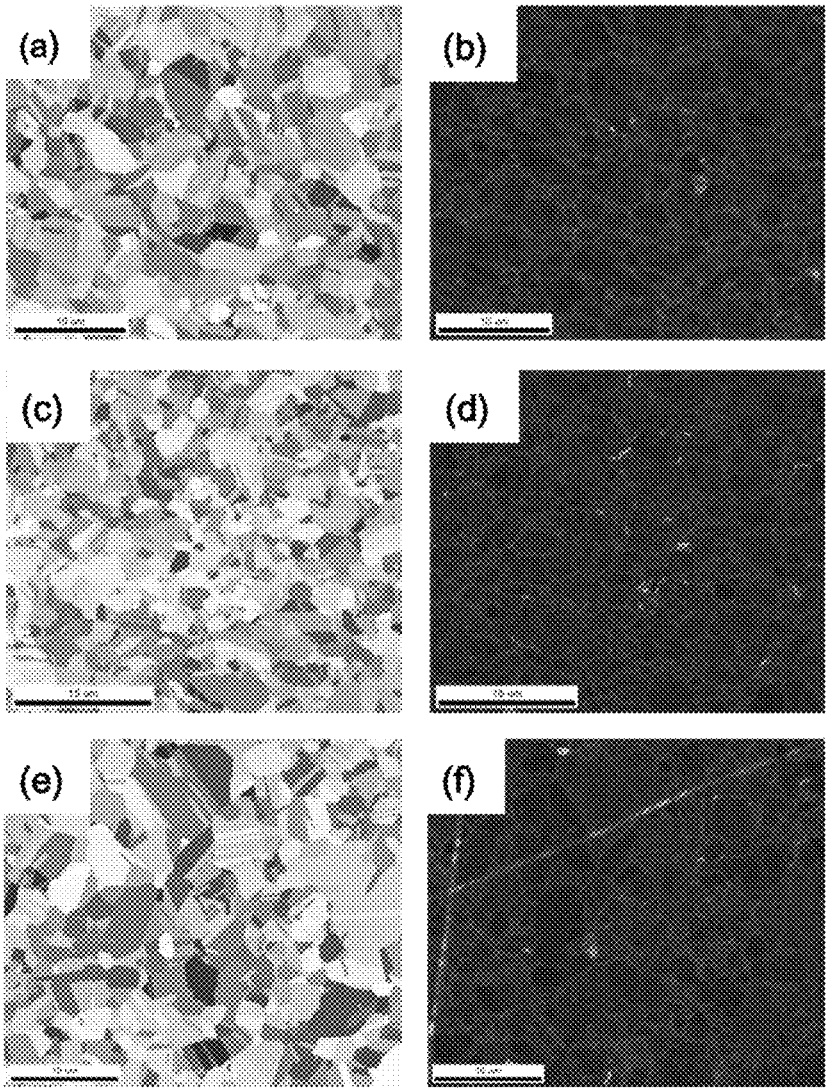
FIG. 4 shows results of an inverse pole figure map (IPF map) and a phase map obtained by electron backscattering diffraction (EBSD) measurement on high entropy alloy specimens of Comparative Example, and Examples 3 and 5 according to the present invention in Table 2.

FIG. 4 shows results of an inverse pole figure map (IPF map) and a phase map obtained by electron backscattering diffraction (EBSD) measurement on high entropy alloy specimens of Comparative Example 1, and Examples 3 and 5 according to the present invention.

As shown in the IPF map for the specimens of Comparative Example 1 (a), Example 3 (c), and Example 5 (e) in FIG. 4, it could be confirmed that the crystal grains were homogenized on all the specimens after the specimen manufacturing process, and had an average grain size of about 4 μm.

In addition, all the specimens were measured to be γ FCC single phases through the phase map results on the specimens of Comparative Example 1 (b), Example 3 (d), and Example 5 (f) in FIG. 4, and thus, it could be confirmed that the specimens of Examples 1 to 5 of the present invention as well as the specimens of Comparative Examples were also the γ FCC single phase high entropy alloys.

Figure 5:
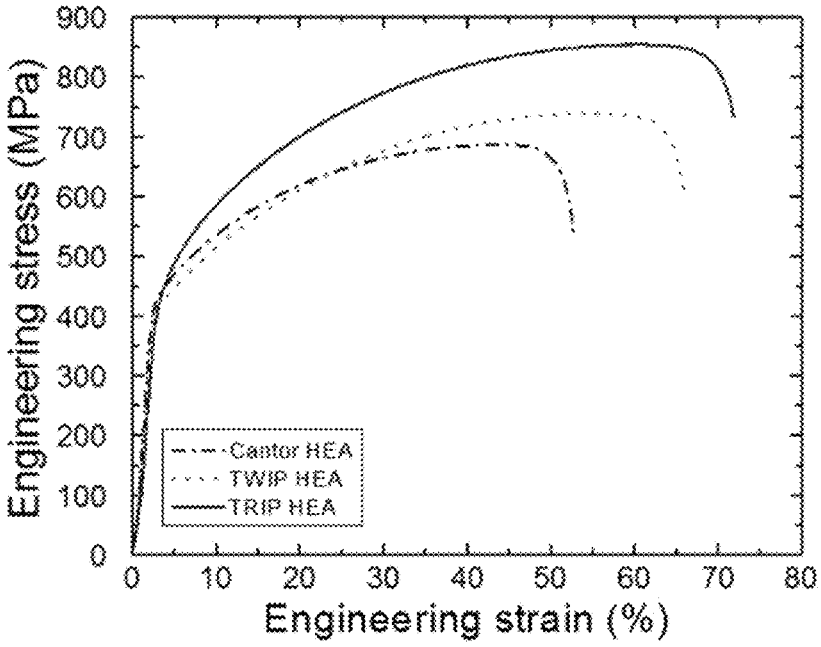
FIG. 5 shows results of a tensile test at room temperature on the high entropy alloy specimens of Comparative Example, and Examples 3 and 5 according to the present invention in Table 2.

FIG. 5 shows results of a tensile test at room temperature on the high entropy alloy specimens of Comparative Example 1, and Examples 3 and 5 according to the present invention. It could be confirmed that the high entropy alloy (Cantor alloy) of Comparative Example 1, in which the constituent elements are included in the same fraction, had a tensile strength of 690 MPa and an elongation of 55%, and thus, mechanical properties were excellent due to basic properties of the high entropy alloy.

However, it could be confirmed that the high entropy alloy specimen of Example 3 (dot) and Example 5 (solid) according to the present invention had a similar yield strength and further improved mechanical properties as compared to those of the high entropy alloy of Comparative Example 1. Specifically, the high entropy alloy of Example 3 had an increased tensile strength of 740 MPa and an elongation of up to 65%, and the high entropy alloy of Example 5 had a more increased tensile strength of up to 860 MPa and an elongation of up to 70%.

As described above, the mechanical properties of the high entropy alloy according to the present embodiment were further improved as compared to those of the high entropy alloy having the same fraction according to Comparative Example 1, which is known to have excellent mechanical properties. Hereinafter, a reason that the mechanical properties of the high entropy alloy according to the present embodiment are improved is described.

Figure 6:
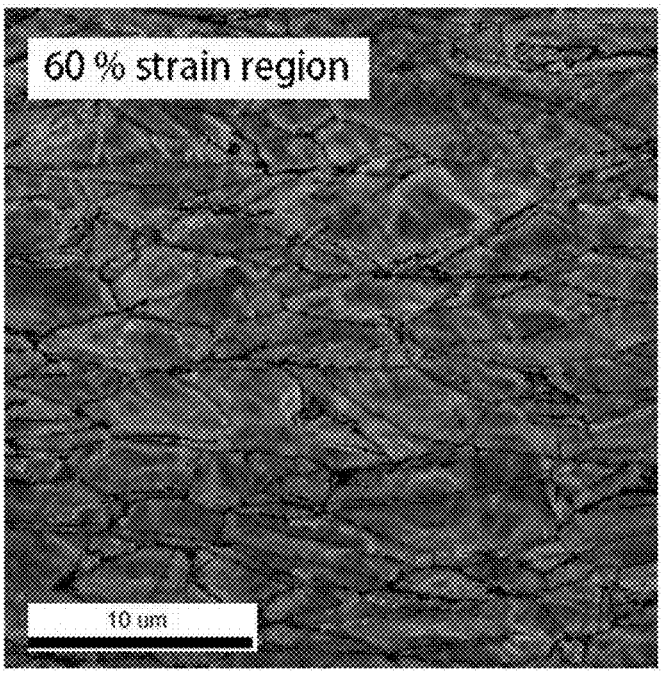
FIG. 6 shows results of a Kernal average misorientation map obtained by EBSD measurement of a 60% local strain region after the tensile test of the high entropic alloy of Comparative Example in Table 2.

FIG. 6 shows results of a Kernal average misorientation map obtained by EBSD measurement of a 60% local strain region after the tensile test of the high entropic alloy of Comparative Example 1. As shown in the drawing, even in a region with 60% large strain, a strain mechanism by dislocation in which strain occurs by activation of the dislocation could be confirmed as previously reported, and twin formation or phase transformation, etc., could be not confirmed.

Figure 7:
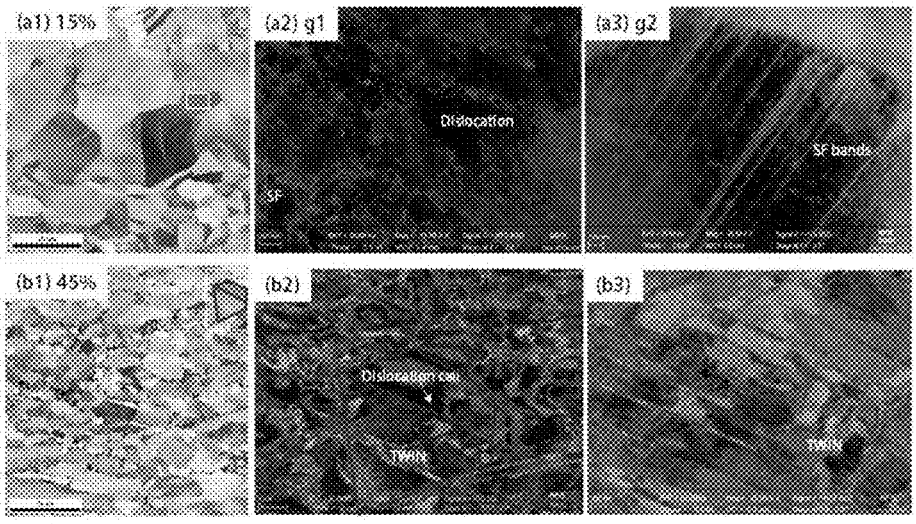
FIG. 7 shows results of the IPF map and an electron channeling contrast image (ECCI) of a 15% local strain region (a1), a strain by dislocation in g1 region in (a1) and (a2), a stacking fault band(SF band) in g2 region in (a1) and (a3), a 45% local strain region (b1), a strain by dislocation and a twin in boxed region in (b1) and (b2), and a twin found in (b1) and (b3) after the tensile test of the high entropy alloy of Example 3 according to the present invention in Table 2.

FIG. 7 shows results of the IPF map and the ECCI of the 15% local strain region (a1) and the 45% local strain region (b1) after the tensile test of the high entropy alloy of Example 3 according to the present invention.

As shown in the case where the high entropy alloy of Example 3 was strained, it could be confirmed that the stacking fault band (SF band) was shown in some regions (a3) in the 15% local strain region (a1), but the strain by dislocation (a2) was mainly shown. On the contrary, when the strain rate was increased to 45%, the stacking fault band and the twin were found as shown in (b2) and (b3), and the strain mechanism exhibited the plastic strain properties of TWIP. The TWIP effect is a phenomenon that is generated in alloys having a FCC structure with sufficiently small stacking fault energy, and is a technique that improves mechanical properties of materials using the twin that is generated during the strain. Specifically, when the twin is generated during the strain, the movement of the dislocation and propagation of cracks, etc., are interrupted, and thus, work hardenability and elongation of the material are improved. It could be appreciated that mechanical properties of the high entropy alloy of Example 3 were improved due to the TWIP effect which was not exhibited in the high entropy alloy of Comparative Example. In particular, in the high entropy alloy of the present invention, the twin was activated even at room temperature, thereby promoting improvement of the mechanical properties at the time of strain.

Figure 8:
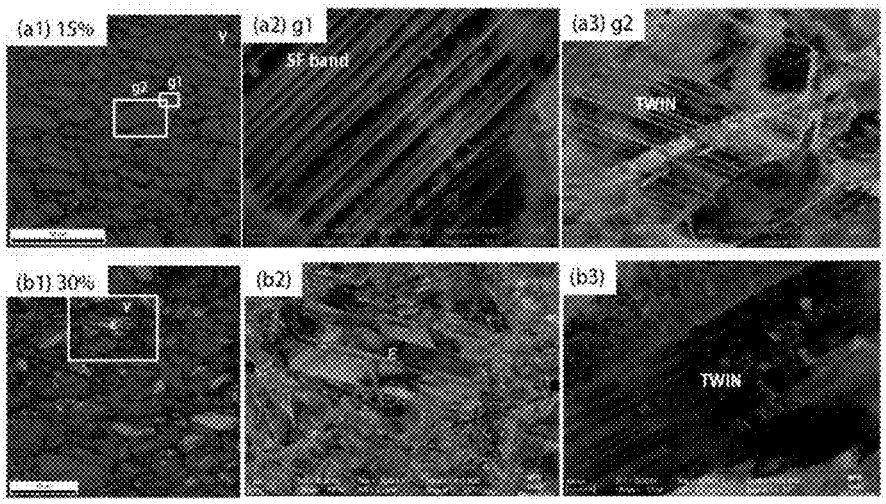
FIG. 8 shows results of the IPF map and the ECCI of the 15% local strain region (a1), a stacking fault band(SF band) in g1 region in (a1) and (a2), a twin in g2 region in (a1) and (a3), a 30% local strain region (b1), a ε HCP phase in boxed region in (b1) and (b2), and a twin found in (b1) and (b3) after the tensile test of the high entropy alloy of Example 5 according to the present invention in Table 2.

FIG. 8 shows results of the IPF map and the ECCI of the 15% local strain region (a1) and the 30% local strain region (b1) after the tensile test of the high entropy alloy of Example 5 according to the present invention.

As shown in the case where the high entropy alloy of Example 5 was strained, it could be confirmed that the stacking fault band (a2), and twin (a3) were found in the 15% local strain region (a1), and thus, the strain mechanism exhibited plastic strain properties of TWIP. In particular, as shown in the phase map (b1) for the 30% local strain region (b1), it could be confirmed that the existing γ FCC phase (Black) region was converted to the ε HCP phase (Grey) region through the phase transformation. This phenomenon is also shown in alloys with FCC structure having sufficiently small stacking fault energy, and it may be confirmed that the plastic strain properties of TRIP in which the phase transformation between FCC phase and HCP phase is generated through twin strain mechanism during the strain, were shown. The TRIP effect is similar to the TWIP effect, but utilizes a stress-induced martensite phase which is generated during the strain. Specifically, when the phase transformation is generated during the strain, a twist effect is generated in the material due to the formed martensite phase, thereby increasing strength of the material, and movement of the dislocation is interrupted by a new interface, and thus, work hardenability and elongation of the material are further improved. It may be appreciated that mechanical properties of the high entropy alloy of Example 5 were further improved due to the TRIP effect which was not exhibited in the high entropy alloy of Comparative Example.

Figure 9:
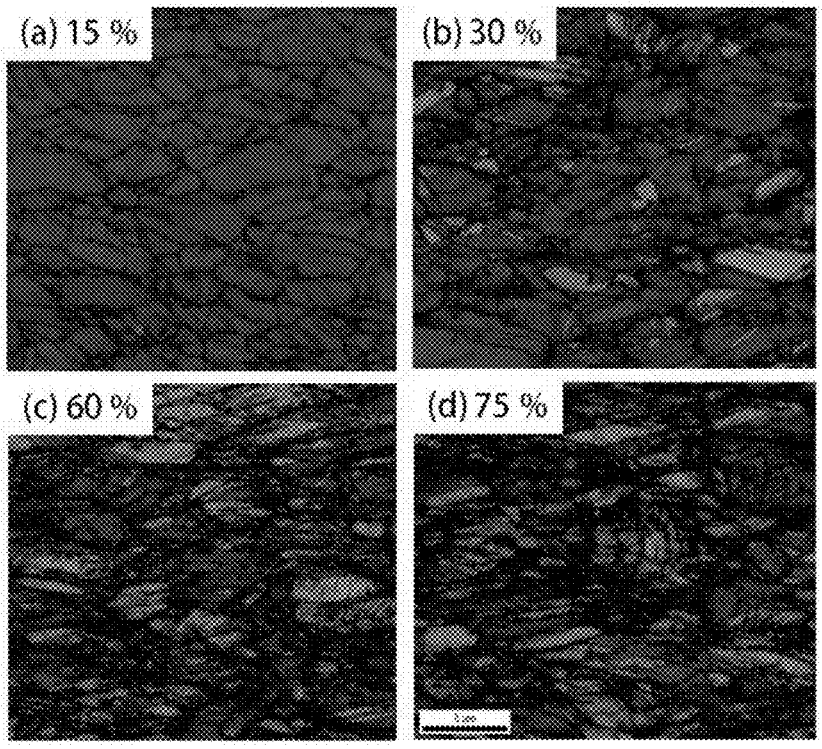
FIG. 9 is phase maps of (a) 15%, (b) 30%, (c) 60%, and (d) 75% local strain regions after the tensile test of the high entropy alloy of Example 5 according to the present invention in Table 2.

FIG. 9 is phase maps of (a) 15%, (b) 30%, (c) 60%, and (d) 75% local strain regions after the tensile test of the high entropy alloy of Example 5 according to the present invention. As shown in the drawing, it could be clearly confirmed that the phase transformation from the existing γ FCC phase (black) region to the ε HCP phase (gray) region was accelerated as the local strain was increased in the high entropy alloy of Example 5.

Figure 10:
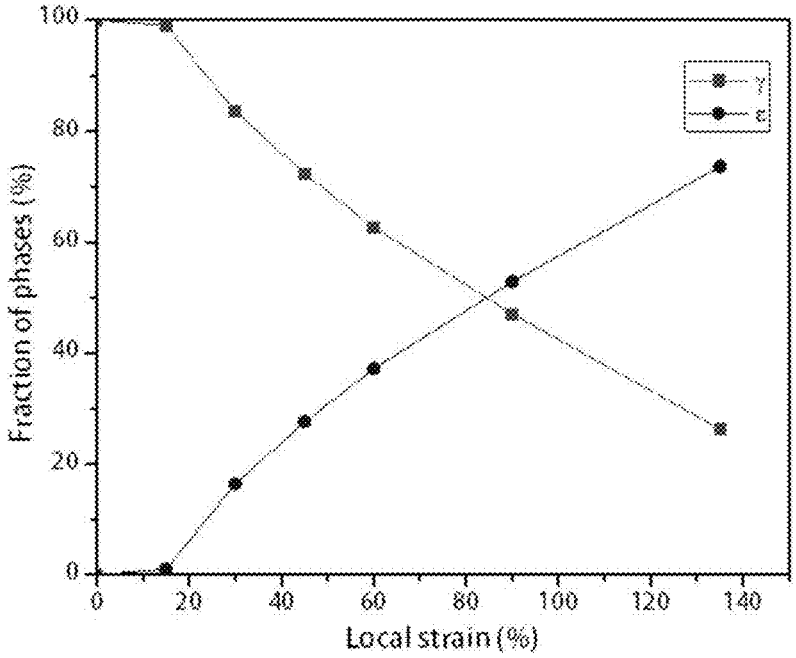
FIG. 10 shows a change in phase fraction according to a local strain rate in the tensile test of the high entropy alloy of Example 5 according to the present invention in Table 2.

FIG. 10 shows a change in phase fraction according to a local strain rate in the tensile test of the high entropy alloy of Example 5 according to the present invention. It could be appreciated that in Example 5, the phase transformation started to be generated in a region having a local strain rate of about 18%, and about 80% of phase transformation from γ to ε was generated at 140% local strain.

Table 3 shows mixing ratios of elements of Comparative Examples 1 to 4 and Examples 1 to 17 of the present invention, and kinds of constitution phases thereof.

TABLE 3

| Specimen | Composition (at %) | Kinds of main phase |
|---|---|---|
| Comparative Example 1 | $Ni_0Co_{40}Fe_{40}Mn_0Cr_{20}$ | α |
| Comparative Example 2 | $Ni_{20}Co_{20}Fe_{20}Mn_{20}Cr_{20}$ | γ |
| Comparative Example 3 | $Ni_{26}Co_{14}Fe_{14}Mn_{26}Cr_{20}$ | γ |
| Comparative Example 4 | $Ni_{14}Co_{21}Fe_{21}Mn_{14}Cr_{30}$ | γ + IC |
| Example 1 | $Ni_8Co_{19}Fe_{45}Mn_8Cr_{20}$ | γ + ε |
| Example 2 | $Ni_8Co_{34}Fe_{34}Mn_8Cr_{16}$ | γ + ε |
| Example 3 | $Ni_8Co_{30}Fe_{30}Mn_8Cr_{24}$ | γ + ε |
| Example 4 | $Ni_8Co_{32}Fe_{32}Mn_8Cr_{20}$ | γ + ε |
| Example 5 | $Ni_8Co_{32}Fe_{32}Mn_8Cr_{18}C_2$ | γ + ε |
| Example 6 | $Ni_8Co_{32}Fe_{32}Mn_8Cr_{18}Al_2$ | γ + ε |
| Example 7 | $Ni_8Co_{32}Fe_{32}Mn_8Cr_{18}Ti_2$ | γ + ε |
| Example 8 | $Ni_8Co_{32}Fe_{32}Mn_8Cr_{18}Nb_2$ | γ + ε |
| Example 9 | $Ni_8Co_{32}Fe_{32}Mn_8Cr_{18}Cu_2$ | γ + ε |
| Example 10 | $Ni_6Co_{34}Fe_{34}Mn_6Cr_{20}$ | γ + ε(α') |
| Example 11 | $Ni_5Co_{35}Fe_{35}Mn_5Cr_{20}$ | γ + ε(α') |
| Example 12 | $Ni_4Co_{35}Fe_{35}Mn_4Cr_{20}N_2$ | γ + ε(α') |
| Example 13 | $Ni_4Co_{35}Fe_{35}Mn_4Cr_{20}V_2$ | γ + ε(α') |
| Example 14 | $Ni_4Co_{35}Fe_{35}Mn_4Cr_{20}Zr_2$ | γ + ε(α') |
| Example 15 | $Ni_4Co_{35}Fe_{35}Mn_4Cr_{20}Mo_2$ | γ + ε(α') |
| Example 16 | $Ni_2Co_{38}Fe_{38}Mn_2Cr_{20}$ | γ + ε(α') |

It was confirmed that in the alloys of Comparative Examples 1 to 4, the γ or α single phase (some intermetallic compounds (ICs) were able to be precipitated) was formed. On the other hand, in Examples 1 to 16 of the present invention, the γ austenite and the ε (α') martensite phase were simultaneously precipitated to show a dual-phase microstructure.

Meanwhile, as shown in Table 3, when the high entropy alloy of the present invention further included 10 at. % or less of at least one element selected from additive elements such as C, N, Al, Ti, V, Cu, Zr, Nb, and Mo, etc., it was possible to improve properties by strengthening solid solution or by strengthening precipitation while maintaining the existing dual-phase matrix structure.

Figure 11:
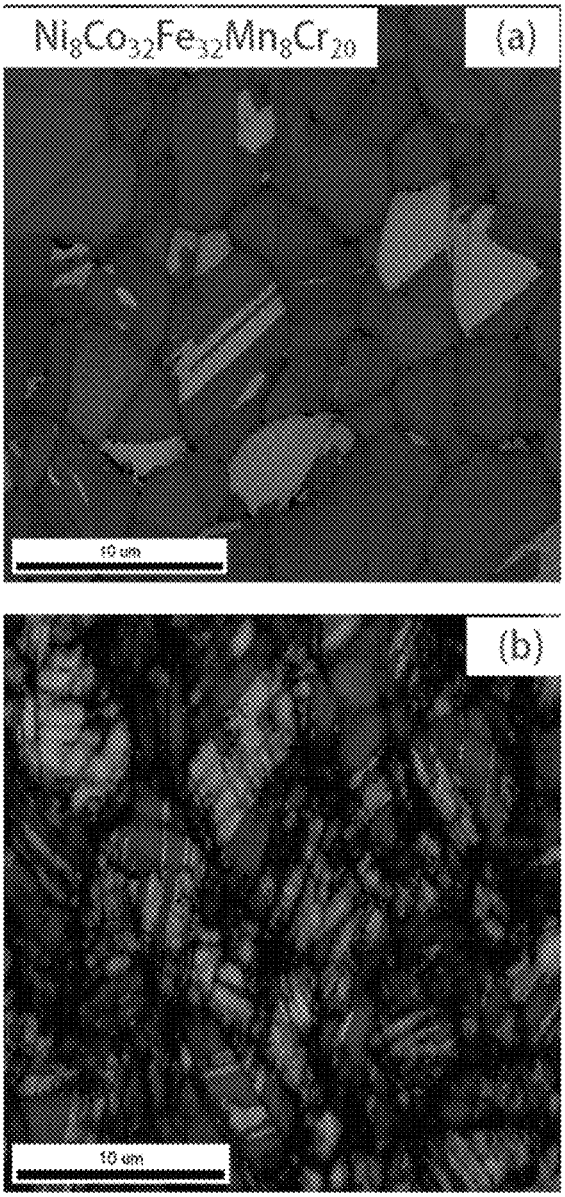
FIG. 11 shows tensile test results at room temperature on a $Ni_{20}Co_{20}Fe_{20}Mn_{20}Cr_{20}$ high entropy alloy specimen of Comparative Example 2 and a $Ni_8Co_{32}Fe_{32}Mn_8Cr_{20}$ high entropy alloy specimen of Example 4 according to the present invention in Table 3.

FIG. 11 shows tensile test results at room temperature on a $Ni_{20}Co_{20}Fe_{20}Mn_{20}Cr_{20}$ high entropy alloy specimen of Comparative Example 2 and a $Ni_8Co_{32}Fe_{32}Mn_8Cr_{20}$ high entropy alloy specimen of Example 4 according to the present invention. It could be confirmed that the high entropy alloy (dash dot) of Example 4 according to the present invention was improved both in strength and elongation at the same time, thereby further improving mechanical properties, as compared to those of the high entropy alloy (solid) of Comparative Example. Specifically, the high entropy alloy of Example 5 had greatly increased tensile strength to about 980 MPa and greatly increased elongation of up to about 60%.

As described above, the mechanical properties of the dual-phase high entropy alloy according to the present embodiment were further improved as compared to those of the high entropy alloy having the same fraction according to Comparative Example 2, which is known to have excellent mechanical properties. Hereinafter, a reason that the mechanical properties of the high entropy alloy according to the present embodiment are improved is described.

Figure 12:
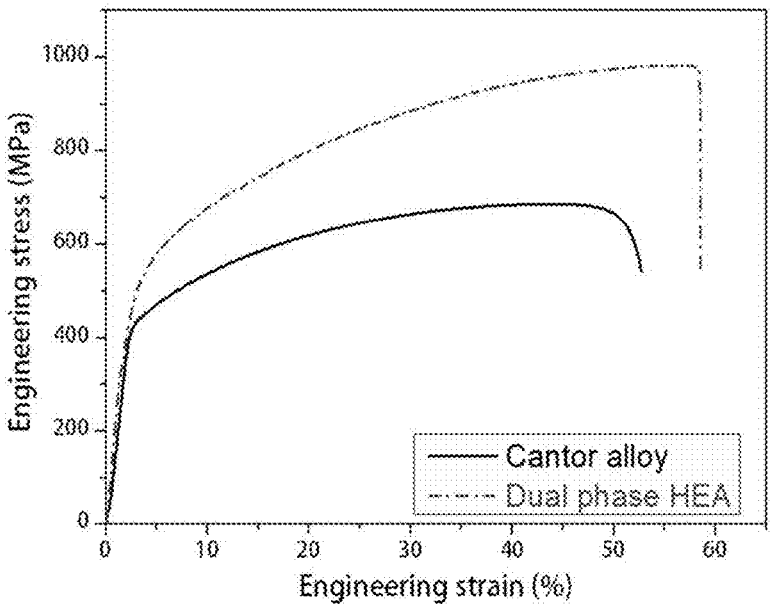
FIG. 12 shows phase map results obtained by electron backscattering diffraction (EBSD) measurements before the tensile test (a) and after the tensile test (b) on the $Ni_{20}Co_{20}Fe_{20}Mn_{20}Cr_{20}$ high entropy alloy specimen of Comparative Example 2 and the $Ni_8Co_{32}Fe_{32}Mn_8Cr_{20}$ high entropy alloy specimen of Example 4 according to the present invention in Table 3.

FIG. 12 shows phase map results obtained by electron backscattering diffraction (EBSD) measurements before the tensile test (a) and after the tensile test (b) on the $Ni_{20}Co_{20}Fe_{20}Mn_{20}Cr_{20}$ high entropy alloy specimen of Comparative Example 2 and the $Ni_8Co_{32}Fe_{32}Mn_8Cr_{20}$ high entropy alloy specimen of Example 4 according to the present invention in Table 3. As shown in the drawing, the twin generated during the strain was activated in the region subjected to 60% of large strain, and the γ austenite phase and the ε martensite phase had phase fractions of 87.5% and 12.5% before strain (FIG. 10(*a*)), respectively, which were changed to 41.6% and 58.4% after strain (FIG. 10(*b*)). Further, when the twin was generated during the strain in a metastable γ austenite phase having a low stacking fault energy, the movement of the dislocation, propagation of cracks, etc., were interrupted, and thus, work hardenability and elongation of the material were improved, and finally, phase instability was activated and the γ austenite phase was phase-transformed into the ε martensite phase.

Figure 13:
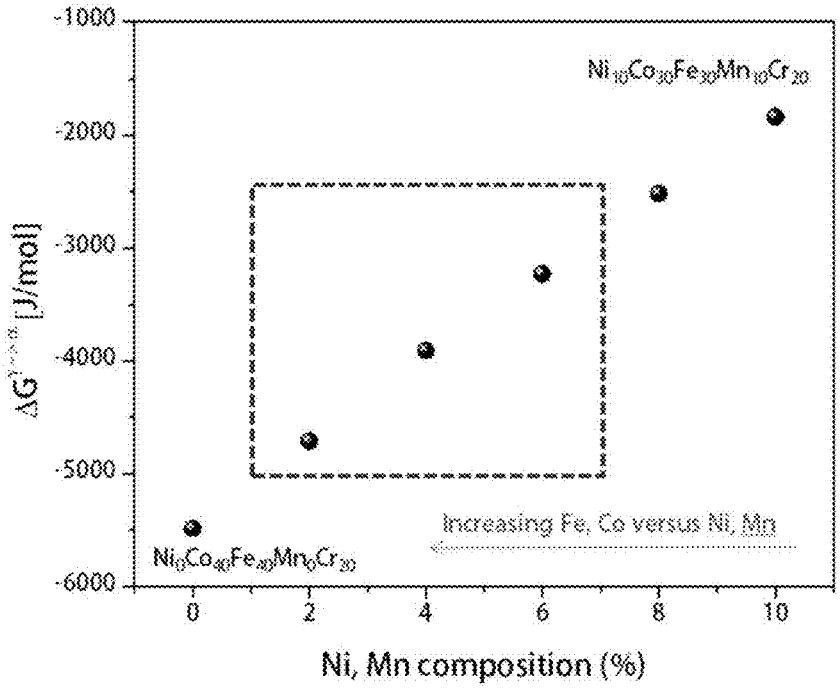
FIG. 13 is a graph showing a free energy change ($\Delta G_{bcc\text{-}fcc}$) at the time of phase transformation by controlling a content ratio of (Fe, Co) to (Ni, Mn) in an increased direction in the NiCoFeMnCr 5-element alloy using Calphad calculation.

FIG. 13 is a graph showing a free energy change ($\Delta G_{bcc\text{-}fcc}$) at the time of phase transformation into the α' martensite phase by controlling a content ratio of (Fe, Co) to (Ni, Mn) in an increased direction in the DeletedTextsalloy using Calphad calculation. As shown in the drawing, when the free energy change ($\Delta G_{bcc\text{-}fcc}$) at the time of the phase transformation from the γ austenite phase to the α' martensite phase was −2500 J/mol or less (based on Calphad calculation) among dual-phase high entropy alloys in which the free energy change ($\Delta G_{hcp\text{-}fcc}$) at the time of the phase transformation from the γ austenite phase to the ε martensite phase was 200 J/mol or less (based on Calphad calculation), it was possible to obtain a dual-phase high entropy alloy capable of being subjected to stress-induced multi-stage phase transformation from the metastable γ austenite through the ε martensite phase up to the α' martensite phase due to shear deformation through intersections of ε martensite bands by the phase transformation during strain.

However, when the free energy change ($\Delta G_{bcc\text{-}fcc}$) at the time of the phase transformation from the γ austenite phase to the α' martensite phase was extremely low to −5000 J/mol or less (based on Calphad calculation), since stability of the metastable γ austenite phase was significantly reduced, a pre-strain microstructure became an α phase having a BCC structure, and thus, the dual-phase high entropy alloy of the present invention could not be manufactured.

Figure 14:
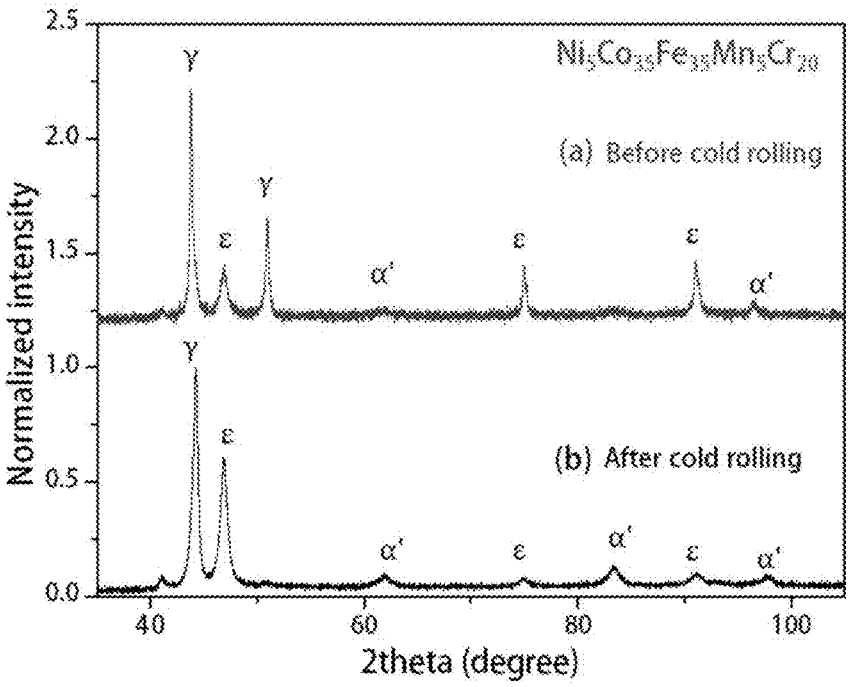
FIG. 14 shows X-ray diffraction analysis results showing phase transformation behaviors of (a) before cold rolling and (b) after cold rolling of the $Ni_5Co_{35}Fe_{35}Mn_5Cr_{20}$ high entropy alloy specimen of Example 12 according to the present invention.

FIG. 14 shows X-ray diffraction analysis results showing phase transformation behaviors of (a) before cold rolling (upper graph in the drawing) and (b) after cold rolling (lower graph in the drawing) of the $Ni_5Co_{35}Fe_{35}Mn_5Cr_{20}$ high entropy alloy specimen of Example 12 according to the present invention. As shown in the drawing, it could be confirmed that in the $Ni_5Co_{35}Fe_{35}Mn_5Cr_{20}$ high entropy alloy, the microstructure in which the γ phase is a main phase in the dual-phase with γ phase and ε (α') phase before cold rolling was changed to the dual-phase structure in which the fraction of the ε phase and the α' phase was increased after cold rolling. These results indicate that as the stacking fault energy in the material is reduced, the metastable γ austenite phase undergoes the multi-stage phase transformation to the α' martensite phase through the ε martensite phase during strain, which may further contribute to improvement of tensile strength and elongation. Further, when the phase transformation into the martensite phase is generated during the strain, a twist effect is generated in the material due to the formed martensite phase, thereby increasing strength of the material, and movement of the dislocation is interrupted by a new interface, and thus, work hardenability and elongation of the material are improved, and mechanical properties are more improved when the multi-stage phase transformation process is performed.

As reviewed above, according to the present invention, the high entropy alloy composed of five elements of Ni, Co, Fe, Mn, and Cr was developed, wherein the high entropy alloy had improved mechanical properties in which strength and elongation were simultaneously improved through the implementation of the single phase TWIP, TRIP or the dual-phase TRIP, the multi-stage phase TRIP strain mechanism, by reducing the stacking fault energy. In this case, the stacking fault energy was predictable by Calphad calculation, and was capable of being easily predicted by $\Delta G'_{hcp\text{-}fcc}$=77a−42b−22c+73d−100e+2186 (a, b, c, d, and e represent compositions (at %) of Ni, Co, Fe, Co, and Cr, respectively) which was derived through fitting of the calculation results. As a result, the high entropy alloy having the TWIP/TRIP property according to Examples may be applied not only as materials for offshore plants and structural materials for polar extreme environment which require excellent toughness and high strength at a low temperature, but also as structural materials for high-temperature extreme environment which require an excellent high-temperature creep property and high-temperature strength through the low stacking fault energy, such as projectile propulsion units, nuclear pressure vessels, cladding tubes, and high-efficiency next generation turbine blades for thermal power generation, etc.

Although the preferred embodiments of the present invention have been disclosed for illustrative purposes, those skilled in the art will appreciate that Examples described above are provided to exemplarily describe technical idea of the present invention, and various modifications, additions and substitutions are possible, without departing from the scope and spirit of the invention as disclosed in the accompanying claims.

The protection scope of the present invention must be analyzed by the appended claims and it should be analyzed that all spirits within a scope equivalent thereto are included in the appended claims of the present invention.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A high entropy alloy having TWIP (twin induced plasticity)/TRIP (transformation induced plasticity) property, which is represented by the following Chemical Formula:

$Ni_aCo_bFe_cMn_dCr_e$ [Chemical Formula]

(a+b+c+d+e=100, 1≤a≤50, 1≤b≤50, 1≤c≤50, 17.5≤d≤50, 10≤e≤25, and 77a−42b−22c+73d−100e+2186≤1500).

2. The high entropy alloy having TWIP/TRIP property of claim 1, wherein:

the high entropy alloy includes 10 at. % or less of at least one element of C, N, Al, Ti, V, Cu, Zr, Nb, or Mo.

3. The high entropy alloy having TWIP/TRIP property of claim 1, wherein:

in Chemical Formula above, 77a−42b−22c+73d−100e+2186≤500.

4. The high entropy alloy having TWIP/TRIP property of claim 1, wherein:

in Chemical Formula above, 77a−42b−22c+73d−100e+2186≤200.

5. The high entropy alloy having TWIP/TRIP property of claim 1, wherein:

the high entropy alloy includes a γ austenite single phase.

6. The high entropy alloy having TWIP/TRIP property of claim 1, wherein:

the high entropy alloy simultaneously includes a γ austenite phase and an ε martensite phase.

7. The high entropy alloy having TWIP/TRIP property of claim 1, wherein:

a γ austenite phase in the high entropy alloy is subjected to multi-stage phase transformation into an α' martensite phase through an ε martensite phase during strain.

8. The high entropy alloy having TWIP/TRIP property of claim 1, wherein:

a free energy change ($\Delta G_{hcp-fcc}$) when a γ austenite phase in the high entropy alloy is phase-transformed into an ε martensite phase during strain is 1500 J/mol or less.

9. The high entropy alloy having TWIP/TRIP property of claim 8, wherein:

when the free energy change ($\Delta G_{hcp-fcc}$) is 1500 J/mol or less, the high entropy alloy exhibits the TWIP property, and when the free energy change ($\Delta G_{hcp-fcc}$) is 500 J/mol or less, the high entropy alloy exhibits the TRIP property.

10. The high entropy alloy having TWIP/TRIP property of claim 8, wherein:

when the free energy change ($\Delta G_{hcp-fcc}$) is 200 J/mol or less, the high entropy alloy simultaneously includes the γ austenite phase and the ε martensite phase.

11. The high entropy alloy having TWIP/TRIP property of claim 8, wherein:

the free energy change ($\Delta G_{hcp-fcc}$) is 500 J/mol or less, and a free energy change ($\Delta G_{hcp-fcc}$) at the time of phase transformation when the γ austenite phase in the high entropy alloy is phase-transformed into the α' martensite phase is −2500 J/mol or less to −5000 J/mol or more.

12. A high entropy alloy having TWIP (twin induced plasticity)/TRIP (transformation induced plasticity) property, which is represented by the following Chemical Formula:

$Ni_aCo_bFe_cMn_dCr_e$ [Chemical Formula]

(a+b+c+d+e=100, 1≤a≤7, 32≤b≤50, 32≤c≤50, 1≤d≤7, 15≤e≤25, and 77a−42b−22c+73d−100e+2186≤1500).

13. A manufacturing method for a high entropy alloy having TWIP (twin induced plasticity)/TRIP (transformation induced plasticity) property comprising:

preparing a raw material; and manufacturing the high entropy alloy by alloying the raw material, wherein in the preparing of the raw material, the raw material is prepared to satisfy the following Chemical Formula, and a free energy change ($\Delta G_{hcp-fcc}$) when a γ austenite phase (fcc) in the manufactured high entropy alloy is phase-transformed into an ε martensite phase (hcp) is 1500 J/mol or less:

$Ni_aCo_bFe_cMn_dCr_e$ [Chemical Formula]

(a+b+c+d+e=100, 1≤a≤50, 1≤b≤50, 1≤c≤50, 17.5≤d≤50, 10≤e≤25, and 77a−42b−22c+73d−100e+2186≤1500).

14. The manufacturing method of claim 13, further comprising:

after the manufacturing of the high entropy alloy, performing homogenization treatment by hot rolling a manufactured ingot to 80% or less of an original thickness, and annealing in an Ar atmosphere at 1200±300° C. for 48 hours or less, followed by quenching.

15. The manufacturing method of claim 14, further comprising:

controlling a microstructure size of the high entropy alloy by cold rolling the homogenized high entropy alloy to 10% or more of an original thickness, and annealing in an Ar atmosphere at 900±200° C. for 24 hours or less, followed by quenching.

16. The manufacturing method of claim 13, wherein:

the free energy change ($\Delta G_{hcp-fcc}$) is 500 J/mol or less.

17. The manufacturing method of claim 13, wherein:

the free energy change ($\Delta G_{hcp-fcc}$) is 200 J/mol or less.

18. The manufacturing method of claim 13, wherein:

a free energy change ($\Delta G_{bcc-fcc}$) at the time of phase transformation when the γ austenite phase in the high entropy alloy is phase-transformed into an α' martensite phase is −2500 J/mol or less to −5000 J/mol or more.

* * * * *